United States Patent [19]

Trbovich

[11] 3,941,381

[45] Mar. 2, 1976

[54] BOARD GAME AMUSEMENT DEVICE

[76] Inventor: Nicholas D. Trbovich, 28 Tanglewood Drive West, Orchard Park, N.Y. 14127

[22] Filed: Aug. 7, 1974

[21] Appl. No.: 495,514

[52] U.S. Cl. ..... 273/85 R; 273/88; 273/95 D; 273/121 R; 273/124 R

[51] Int. Cl.[2] ..... A63F 7/06; A63F 7/14

[58] Field of Search ..... 273/85 R, 85 F, 121, 124, 273/39, 26 A, 88, 94, 95 D, 128 R

[56] References Cited

UNITED STATES PATENTS

| | | | |
|---|---|---|---|
| 1,282,418 | 10/1918 | Haskell | 273/124 R UX |
| 1,658,097 | 2/1928 | Pierce | 273/26 A X |
| 1,889,899 | 12/1932 | Langenhaun | 273/124 R |
| 2,094,673 | 10/1937 | Rudolph | 273/121 R |
| 2,275,222 | 3/1942 | Farquhar | 273/39 |
| 3,206,210 | 9/1965 | Bard | 273/128 R |
| 3,406,970 | 10/1968 | Webb, Jr. | 273/88 X |
| 3,767,200 | 10/1973 | Lohr | 273/128 R X |

FOREIGN PATENTS OR APPLICATIONS

| | | | |
|---|---|---|---|
| 1,059,276 | 11/1953 | France | 273/39 |

*Primary Examiner*—Paul E. Shapiro
*Attorney, Agent, or Firm*—Christel & Bean

[57] ABSTRACT

An amusement game apparatus has a guide surface, a playing surface and a deflecting surface, and a freely movable player piece moved or propelled along the guide surface is directed by the deflecting surface onto the playing surface. The deflecting surface is curved and the shape varies in a direction transverse to the direction of movement of the player piece thereby varying the location where the player piece lands on the playing surface. The game includes a plurality of indicia-bearing elements such as cards for selective placement on the playing surface at different times whereby several different types of games, for example hockey, basketball, baseball and football, can be played at different times on the same apparatus. A manually-operable player element is movably connected to the playing surface for blocking or directing movement of the player piece.

7 Claims, 14 Drawing Figures

FOUL
1 POINT
1 POINT

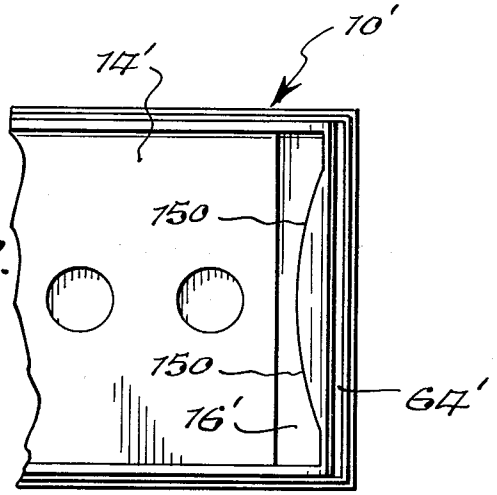
Fig. 12.
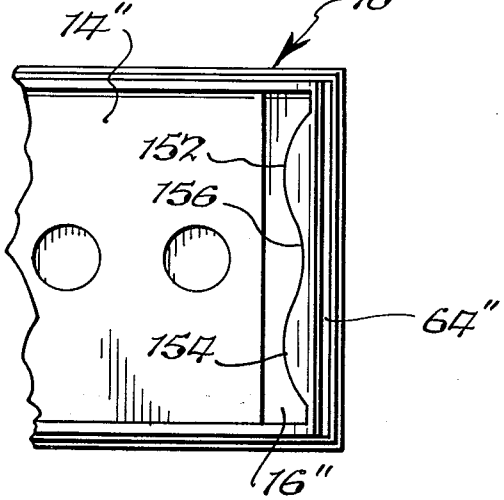
Fig. 13.
Fig. 14.
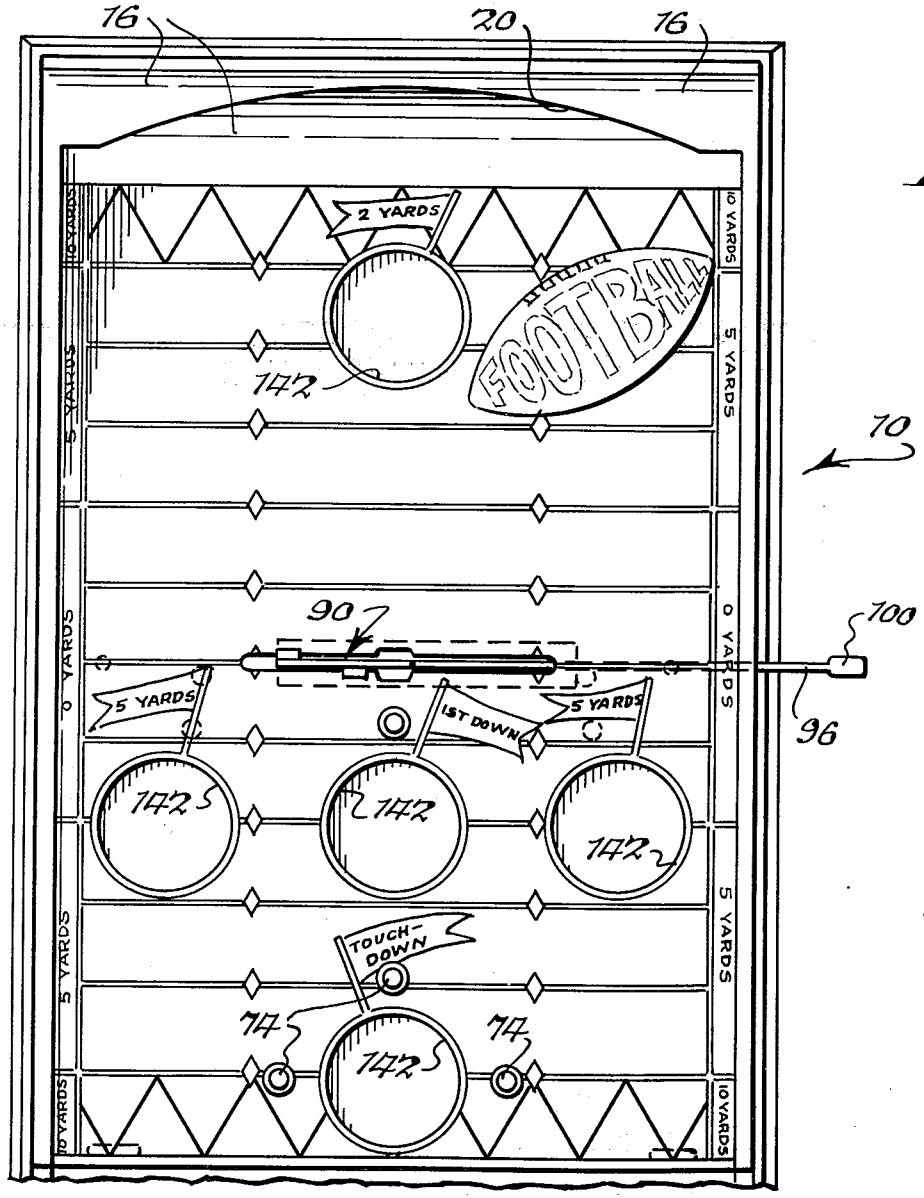

BOARD GAME AMUSEMENT DEVICE

BACKGROUND OF THE INVENTION

The invention relates to games played for amusement, and more particularly to a new and improved tabletop game apparatus in the form of an athletic game.

Various amusement games, based upon the generally recognized rules of athletic sports, are known. Usually, these games are of a nature that they are for the playing of a single sport, so that separate games must be obtained and used for the playing of different sports. In addition, many of these games are designed in a manner such that the outcome of the game is dependent almost entirely upon the element of chance rather than the skill of the players.

SUMMARY OF THE INVENTION

It is, therefore, a primary object of this invention to provide a new and improved amusement game in the form of tabletop athletic game apparatus.

It is a further object of this invention to provide such a game readily adaptable to the playing of different types of athletic games.

It is a further object of this invention to provide such a game in which the skill of the players is a factor in determining the outcome of the game.

It is a further object of this invention to provide such a game which is relatively simple in construction and economical to manufacture.

The present invention provides amusement game apparatus comprising means defining a guide surface, a playing surface and a deflecting surface between the guide surface and the playing surface. the deflecting surface is shaped to direct a player piece moving therealong onto the playing surface and the shape varies in a direction generally transverse to the path of the player piece to vary the location where the player piece lands on the playing surface. A plurality of indicia-bearing elements are provided for selective placement on the playing surface one at a time, allowing different types of games to be played at different times on the apparatus. A player element is movably connected to the playing surface for further influencing movement of the player piece.

the foregoing and additional advantages and characterizing features of the present invention will be clearly apparent upon a reading of the ensuing detailed description together with the included drawing wherein:

BRIEF DESCRIPTION OF THE DRAWING FIGURES

FIG. 12 is a fragmentary top plan view of the amusement game of the present invention provided with parts for simulating a football game;

FIG. 13 is a fragmentary top plan view of the amusement game of the present invention provided with an alternative form of deflecting surface; and FIG. 14 is a fragmentary top plan view of the amusement game of the present invention provided with an alternative form of deflecting surface.

DETAILED DESCRIPTION OF THE ILLUSTRATED EMBODIMENTS

Figure 1:
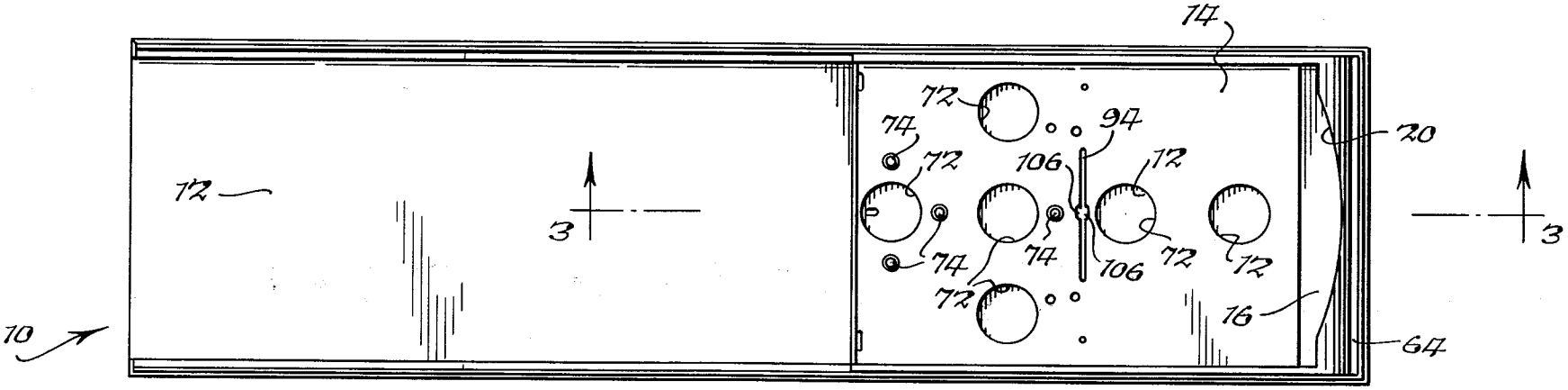
FIG. 1 is a top plan view with parts removed of an amusement game according to the present invention.
Figure 2:
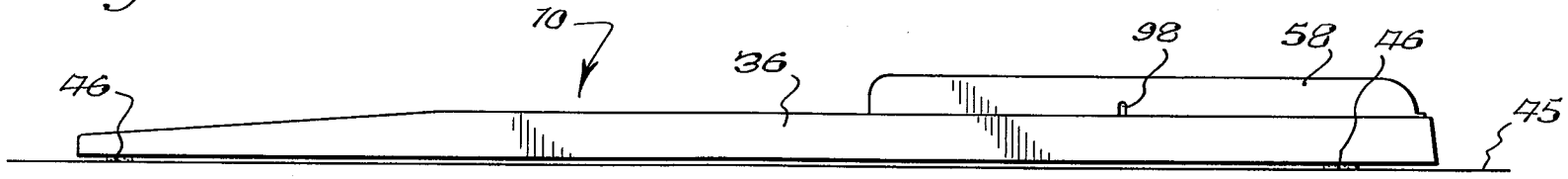
FIG. 2 is a side elevational view thereof.
Figure 3:
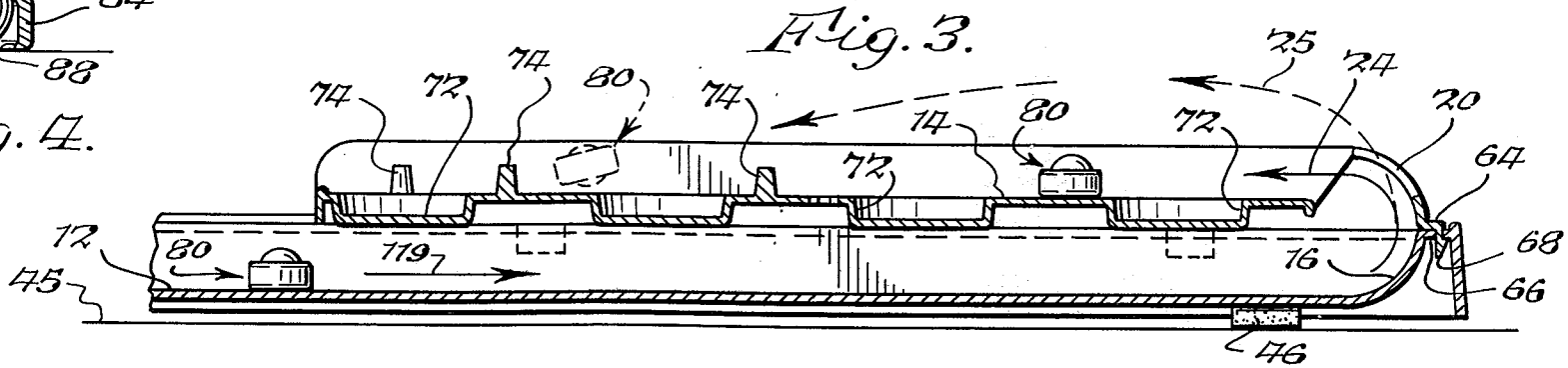
FIG. 3 is a fragmentary sectional view taken about on line 3—3 of FIG. 1.

Referring now in detail to the drawings, there is shown in FIGS. 1–3 a game board, generally designated 10, including a guide surface portion or element 12, a playing surface portion or element 14 and a deflecting surface portion or element 16 operatively located between guide surface 12 and playing surface 14. In preferred form, board 10 is rectangular having a length several times greater than the width thereof, for example about three and one-half times greater. Guide surface portion 12 extends along board 10 from one end, for example the left-hand end as viewed in FIGS. 1 and 2, almost along the entire length of board 10 toward the opposite end thereof. This end of guide surface 12 meets deflecting surface portion 16 adjacent the corresponding end of board 10 which is the right-hand end as viewed in FIGS. 1 and 2. Guide surface 12 is generally smooth and planar, being disposed generally horizontally when board 10 is placed on a tabletop or similar supporting surface for use.

Deflecting surface portion 16 preferably comprises in part a curved integral extension of guide surface portion 12, and surface 16 extends along the one end of board 10, i.e. the right-hand end as viewed in FIGS. 1–3, being disposed generally transverse relative to the length of board 10 and guide surface 12. In accordance with the present invention the shape of deflecting surface varies in a direction transverse to guide surface 13. In particular, deflecting surface 16 is shaped to include different degrees of curvature along its length, i.e. along the transverse dimension of guide surface 12. Expressed differently, the curvilinear distance along and around surface 16 varies over the lengthwise dimension of surface 16. In particular, each end portion of deflecting surface 16 is of arcuate, generally semicircular cross-section thereby shaped to include a generally inclined portion leading upwardly and forwardly from guide surface 12 followed by an intermediate generally vertical portion which, in turn, is followed by a portion curved to provide a return or rearward bend relative to guide surface 12. The central portion of deflecting surface 16 includes an inwardly curved edge 20, extending along surface 16 from one end portion to the other thereby providing a central portion of different curvature as compared to the end portions. The curvilinear length of the central portion therefore is less than the curvilinear length of the end portion. In particular, the central portion is of generally arcuate cross-section shaped to include a generally inclined portion leading upwardly and forwardly from guide surface 12 followed by an intermediate generally vertical portion which, in turn, is followed by a portion curved to provide a return or rearward bend relative to guide surface 12. Adjacent the mid-point of the length of surface 16 this return portion is relatively short thereby having a relatively small degree of curvature. In particular this middle or central portion is of minimum curvilinear length and considerably shorter as compared to the length or extent of the opposite end portions. Proceeding from the middle in opposite directions along surface 16, edge 20 is curved whereby this return portion increases gradually in length and degree of curvature in directions approaching the opposite end portions of surface 16.

By virtue of the foregoing construction, a player piece or element moving along guide surface 12 and onto deflecting surface 16 is directed by surface 16 onto playing surface 14 as shown in FIG. 3 and described in further detail presently. Depending upon the portion of deflecting surface 16 along which a player piece moves it will have a different path or trajectory onto playing surface 14 due to the varying shape or curvature of surface 16 in a direction transverse to the direction of movement of a player piece along surface 12. As shown in FIG. 3, a player piece moving along either end portion of surface 16 is given a path or trajectory which includes a relatively sharp return bend and which path is relatively low as designated by the arrow 24 in FIG. 3. On the other hand, a player piece moving along the middle portion of surface 16 is given a path or trajectory which has a relatively wider or larger return bend and which therefore is relatively higher as designated by the arrow 25 in FIG. 3.

Figures 5, 6, 7:
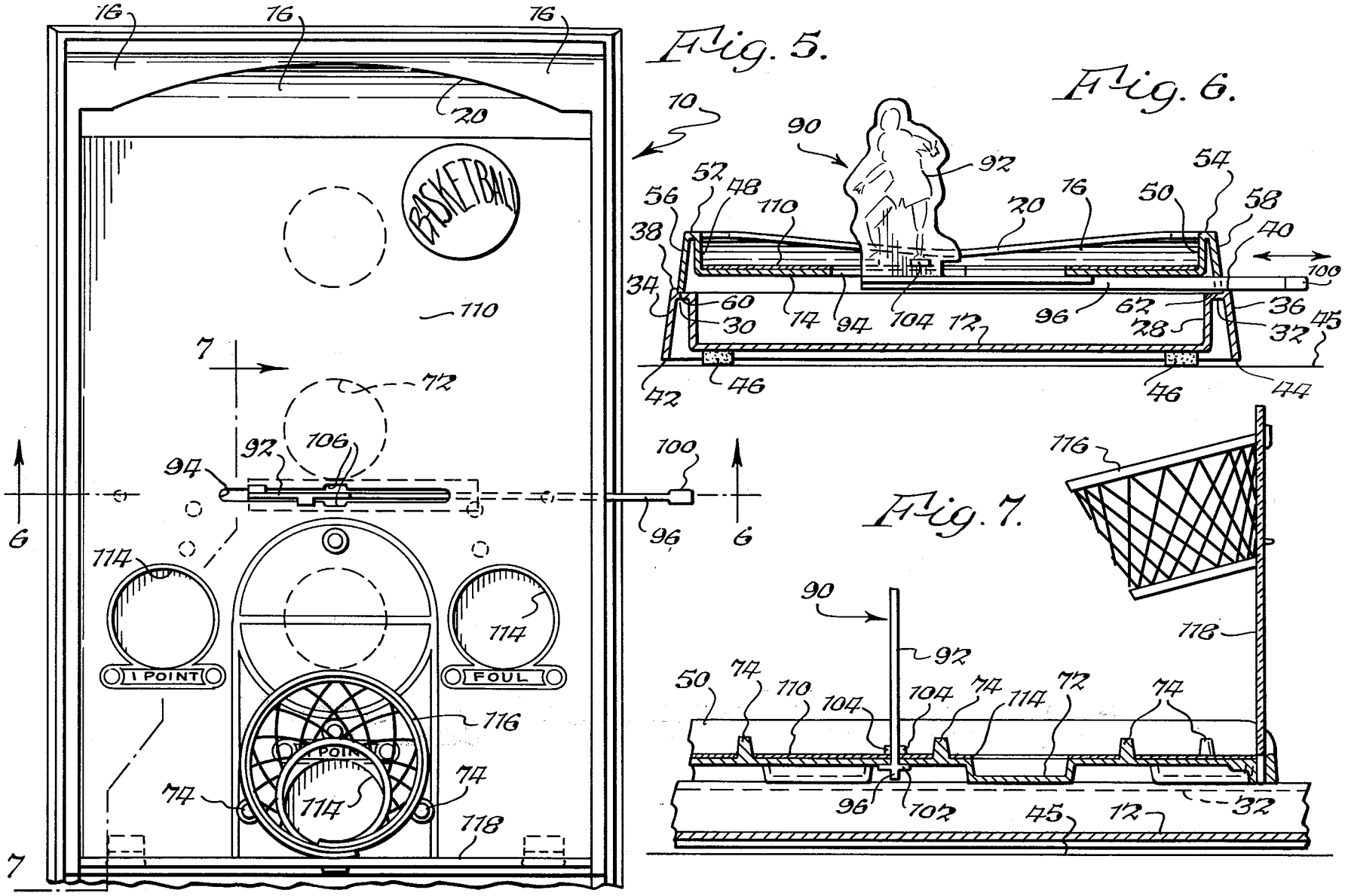
FIG. 5 is a fragmentary top plan view of the amusement game of the present invention provided with parts for simulating a basketball game.
FIG. 6 is a transverse sectional view taken about on line 6—6 of FIG. 5.
FIG. 7 is a fragmentary sectional view taken about on line 7—7 of FIG. 5.

Playing surface portion 14 preferably is located in game board 10 parallel to and spaced from guide surface portion 12 and extending for a portion of the length of guide surface 12 and terminating at one end adjacent deflecting surface 16. As shown in FIG. 6, game board 10 includes opposite side wall portions 26, 28 extending from the opposite side edges of guide surface portion 12 and being disposed generally parallel to each other and generally perpendicular to the plane of guide surface 12. In preferred form, side walls 26, 28 each are of a length substantially equal to the length of guide surface 12. Side walls 26 and 28, in turn, each meet an inner edge of supporting surfaces 30 and 32, respectively. The supporting surfaces or webs 30, 32 extend outwardly or away from guide surface 12 and the corresponding one of the side walls 26, 28. Webs 30 and 32 preferably are both disposed in planes generally parallel to the plane of guide surface 12, and preferably webs 30 and 32 are coplanar. Webs 30 and 32, in turn, each meet an upper end of depending side flanges 34 and 36, respectively. Flanges 34, 36 preferably are slightly inclined outwardly thereby defining a small acute angle with a plane disposed perpendicular with respect to the plane of guide surface 12. Flanges 34 and 36 have upper edges 38 and 40, respectively, which are located preferably a slight distance above the corresponding webs 30 and 32. Flanges 34 and 36 also have lower edges 42 and 44, respectively, and flanges 34 and 36 both are of a width such that lower edges 42, 44 are spaced slightly above the table top or supporting surface 45 on which game board 10 is placed during playing thereof. In this connection, supporting elements or pads 46 are provided beneath guide surface 12 for supporting game board 10 in a cushioning manner.

The supporting surfaces or webs 30, 32 support playing surface portion 14 above guide surface 12 in the following manner. At the opposite sides of playing surface portion 14 there are provided side walls 48 annd 50 which preferably are mutually parallel and each disposed in a plane perpendicular to playing surface portion 14. Side walls 48 and 50, in turn, meet web portions 52 and 54, respectively, each of which, in turn, meet depending side flanges 56 and 58, respectively. Side flanges 56 and 58 both are inclined slightly outwardly and terminate in lower edges 60 and 62, respectively. The assembly is dimensioned such that edges 60 and 62 abut supporting webs 30 and 32, respectively, adjacent or against the shoulders provided by the extending or projecting upper edges 38 and 40 of side flanges 34 and 36.

According to a preferred manner of constructing game board 10, the portion of deflecting surface 16 including edge 20, i.e. approximately the upper half of deflecting surface portion 16, is joined integrally at opposite ends of surface 16 to the side walls 48, 50 and webs 52, 54 leading from playing surface portion 14 adjacent one end thereof, i.e. at the right-hand end as viewed in FIGS. 1–3. This part of deflecting surface portion 16 terminates in an outwardly extending flange 64 shown in FIG. 3 which is supported on a web 66 extending outwardly from the bottom half of deflecting surface portion 16. Flange 64 and web 66 preferably are both disposed in planes parallel to guide surface 12 and supporting surface 14. A latch or hook type member 68 depends from flange 64 and snapfits in an opening provided in web 66. Similar latch or hook members are provided along the opposite edges 60 and 62 of side flanges 56 and 58, respectively, for snap-fitting into corresponding openings provided in webs 30 and 32. Forming game board 10 of plastic or light-weight sheet metal parts provides flexibility for assembling or removing the parts.

Playing surface portion 14 is formed to include recesses or pockets 72 therein for receiving player pieces or elements moving along surface 14 in a manner which presently will be described. The relative spacing and arrangement of pockets or wells 72 provides adaptability to the playing of various games which will be explained in detail presently. Playing surface portion 14 also is formed to include bosses or projections 74 which extend upwardly from surface 14 and preferably are of frusto-conical shape. Projections 74 serve as obstructions or deflecting elements for player pieces moving along surface 14 in a manner which will be described.

Figure 4:
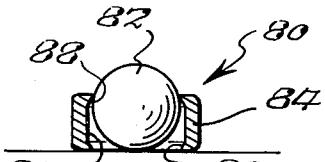
FIG. 4 is a vertical sectional view of a player piece for use in the game of the present invention.

The game of the present invention further comprises a player piece adapted for free movement along the surfaces of game board 10. At least one but preferably a plurality of player pieces are provided with the game apparatus, and one such player piece is shown in FIG. 4 and generally designated 80. Each player piece 80 comprises a ball element 82, preferably of metal, embraced by a ring element 84, preferably of plastic. Ring element 84 is substantially rectangular in cross-section, having an axial length less than the diameter of ball element 82. Ring element 84 has an annular inner surface portion 86 of a diameter slightly greater than the diameter of ball 82. Ring element 84 also is formed to include annualr edges 88 adjacent each axial end thereof projecting inwardly of surface portion 86. The inner diameters of edges 88 are slightly less than the diameter of ball 82. As a result, ball element 82 is loosely fitted but captively retained in ring element 84. As player piece 80 moves along a surface, such as along guide surface 12 as illustrated in FIG. 3, ball element 82 rotates within ring 84. Sliding friction between the lower end surface of ring 84 and the surface along which player piece 80 moves eventually causes player piece 80 to come to a stop.

The game of the present invention further comprises a manually-operable player element generally designated 90 as shown in FIG. 6 movably connected to playing surface 14 and extending outwardly and upwardly therefrom. In particular, player element 90 includes a planar or plate-like portion 92 having a peripheral shape or configuration simulating an individual member or player on an athletic team which can be augmented by indicia or artwork provided thereon. Portion 92 is disposed in a plane extending perpendicular to playing surface 14 and transverse to the longitudinal axis of game board 10. Playing surface 14 is provided with an elongated slot 94 as shown in FIG. 1 having a width slightly greater than the thickness of portion 92 and extending transverse to the longitudinal axis of game board 10 and having a length extending over a significant portion of the width of playing surface 14. Slot 94 preferably is located generally centrally between the ends of playing surface 14 and extends along about one-half the width of surface 14, being located substantially equi-distant from the sides thereof. The lower or bottom end of player portion 92 extends through slot 94 and below surface 14 where it joins a manipulator or operator member in the form of a lever arm 96 which lies below surface 14. The longitudinal axis of lever arm 96 is disposed generally parallel to the plane of surface 14. Lever 96 is disposed generally perpendicular to the longitudinal axis of game board 10 and extends through an opening 98 provided inside flange 58 so that a handle portion 100 at the end of lever 96 is externally accessible for manual operation.

The player element 90 comprising portion 92 and lever 96 is movably retained and supported in slot 94 by means of an elongated plate-like member 102 attached to lever 96 and located below surface 14. Member 102 has a width greater than the width of slot 94 so that upward or vertical movement of player element 90 is limited or restricted. Downward movement thereof is limited or restricted by a pair of tabs 104 extending outwardly from opposite surfaces of portion 92 and disposed in a horizontal plane above surface 14. Tabs 104 are of sufficient length to extend over the respective portion of slot 94 and are in sliding contact with surface 14. Slot 94 is provided with aligned, oppositely directed enlarged portions 106 each of a length and width greater than the corresponding dimensions of the respective tab 104 permitting convenient assembly and removal of player element 90. This is done simply by raising or lowering player element 90 as it is moved or drawn along slot in a manner clearing plate 102 and tabs 104 through the enlarged openings 106.

The game of the present invention further comprises at least one indicia bearing element in the form of a plate or card of suitable material such as carboard or plastic and adapted to be placed on playing surface 14 to provide the appropriate indicia and other markings on surface 14 for playing the game. Each card also has openings located to be in registry or alignment with some or all of the pockets 72 provided in playing surface 14. In addition, each card is provided with a slot allowing portion 92 of player element 90 to extend upwardly therethrough and each card has openings for receiving projections 74. According to a preferred mode of the present invention, plates or cards are available with a single game board 10 thereby allowing several different types or varieties of games to be played selectively on a single game apparatus.

By way of illustration, FIGS. 5–7 show the game apparatus fitted with a card or plate 110 provided with indicia and markings for a basketball game. Card 110 is dimensioned to cover the entire area of playing surface 14, and the portion of card 110 between player element 90 and deflecting surface 16 is solid thereby covering the pockets 72 in that portion of playing surface 14. The other half of card 110 is marked to indicate the key or 3-second zone and foul line found at each end of a conventional basketball court. The middle one of the row of three pockets 72 adjacent and along player element 90 is covered by plate 110, and openings 114 are provided in plate 110 in registry or alignment with the outer two pockets 72 as well as the single pocket at the end of surface 14. An accessory in the form of a simulated basket 116 is provided, being supported at an elevated position above surface 14 and card 110 by a plate-like member 118. Basket 116 and plate 118 preferably are of plastic, being snap-fit together in a suitable manner or even integrally joined, and the bottom end of plate 118 is connected to surface 14 such as by tabs or fingers on plate 118 which fit tightly but releasably into slots provided in surface 14.

The indicia provided on card 110 indicates that a player piece which lands or settles in the pocket 72 under basket 116 scores two points, one landing in the pocket 72 in the left-hand region as viewed in FIG. 5 scores one point and one landing in the right-hand pocket draws a foul. The game is played by one person propelling or forcing by hand a player piece 80 along guide surface 12 toward deflecting surface 16 in the direction indicated by arrow 119 in FIG. 3. This person tries to influence the path of player piece 80 into playing surface 14 by utilizing the variable shape or curvature of surface 16 transverse to the path of player piece 80 and by controlling the manual force applied thereto so as to control its speed. This person uses his skill and these factors and combinations thereof to attempt to land the player piece 80 in the pockets or wells 72 on surface 14 marked with scoring points and to avoid the well marked "foul." The projections around the pocket below basket 116 increase the difficulty of placing the player piece in this pocket. The other person playing the game, however, manipulates player element 90 in an attempt to block the moving player piece 80 from landing or entering in the scoring wells and to guide or allow the player element to enter the pocket marked "foul." This is done by moving or recipricating player element 90 by means of lever 96 grasped at handle portion 100. After one or any predetermined number of tries or runs, the persons playing the game switch roles or positions and the score is kept in a conventional manner.

Figures 8, 9:
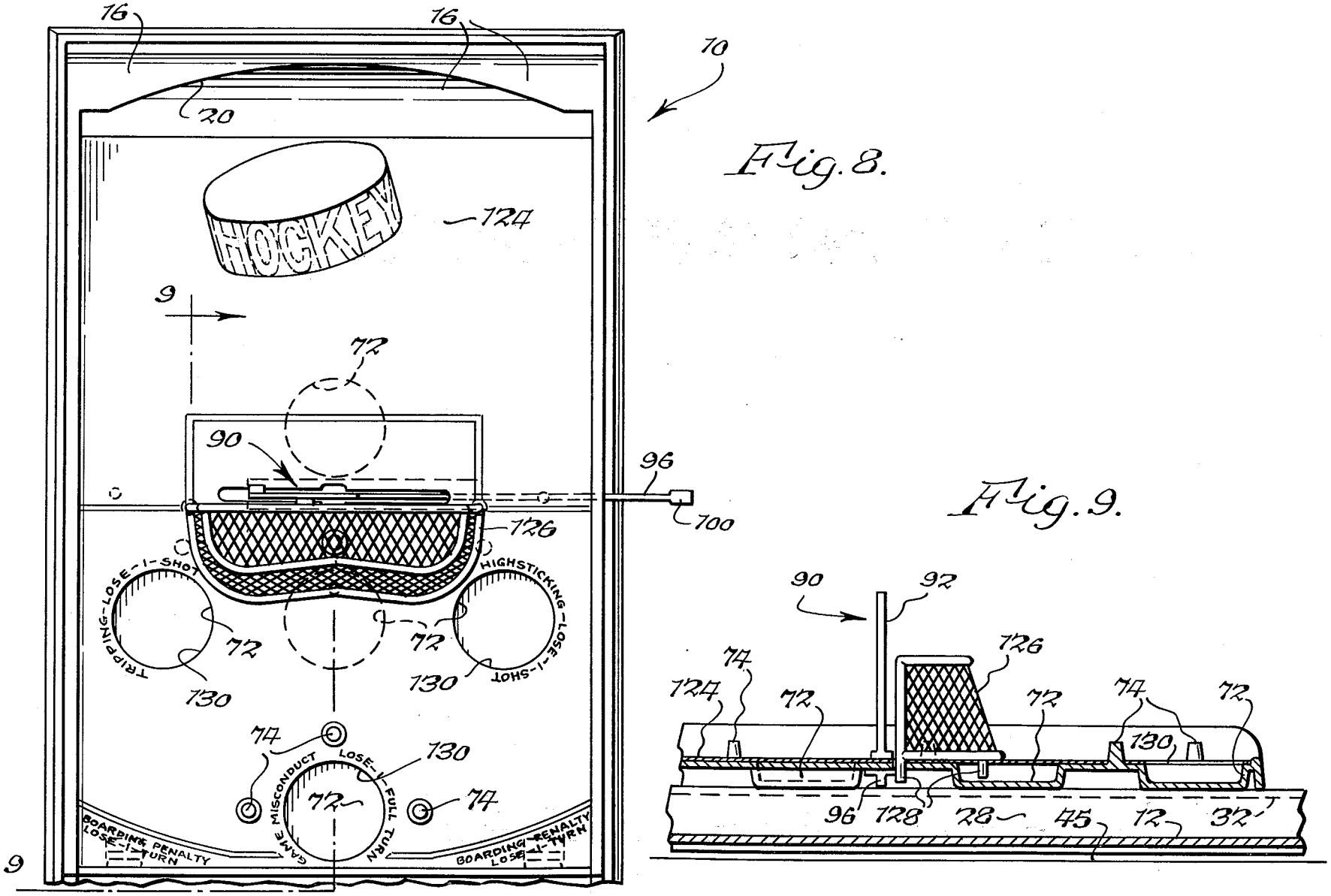
FIG. 8 is a fragmentary top plan view of the amusement game of the present invention provided with parts for simulating a hockey game.
FIG. 9 is a fragmentary sectional view taken about on line 9—9 of FIG. 8.

FIGS. 8 and 9 illustrate the game apparatus provided with a card 124 having indicia and markings for a hockey game. Card 124 is of a size covering the entire area of playing surface 14, and the portion of card 124 between player element 90 and deflecting surface 16 is solid thereby covering the pockets in that portion of surface 14. An accessory element 126 simulating a hockey goal net is connected to card 124 and surface 14 just behind player element 90 so that player element 90 is positioned between deflecting surface 16 and the open end of net 126. Net element 126 is provided with prongs or fingers 128 which are tightly but releasably fitted or received in openings provided in card 124 ad surface 14. Movement of portion 92 of player element 90, which simulates the hockey goal tender, along slot 94 is in or along a plane parallel to the plane of the opening in net element 126. The size of the opening is such that reciprocal movement of player element 90 can prevent entry of a player piece 80 into the net 126. Board 124 is marked to indicate the conventional goal crease area in front of net 126. Openings 130 are provided in plate 124 in registry or alignment with the pockets 72 in the other portion or half of playing surface 14 with the exception of the pocket directly behind net element 126. A player piece which lands in any of these pockets incurs one of the various penalties common to the game of hockey as specified by the indicia on plate 124 adjacent openings 130. In addition, further penalty-indicating markings can be provided adjacent the far end of card 124.

The game shown in FIGS. 8 and 9 is played by one person propelling or forcing by hand a player piece 80 along guide surface 12 in a manner similar to that of the game previously described but in this instance attempting to land the player piece in net 126. This person uses his skill in combination with the varying shape of deflecting surface 16 and with selective controlled application of manual force to player piece 80 to land it in net 126 and to avoid landing it in the pockets or areas marked with penalties. The other person playing the game manipulates player element 90 simulating the hockey goal tender to attempt to block the player piece 80, which simulates the hockey puck, from entering net 126, and when possible to allow or guide player piece 80 to land in a penalty pocket or area. After one or any predetermined number of tries or runs, the persons playing the game switch roles or positions and the score is kept in a conventional manner.

Figures 10, 11:
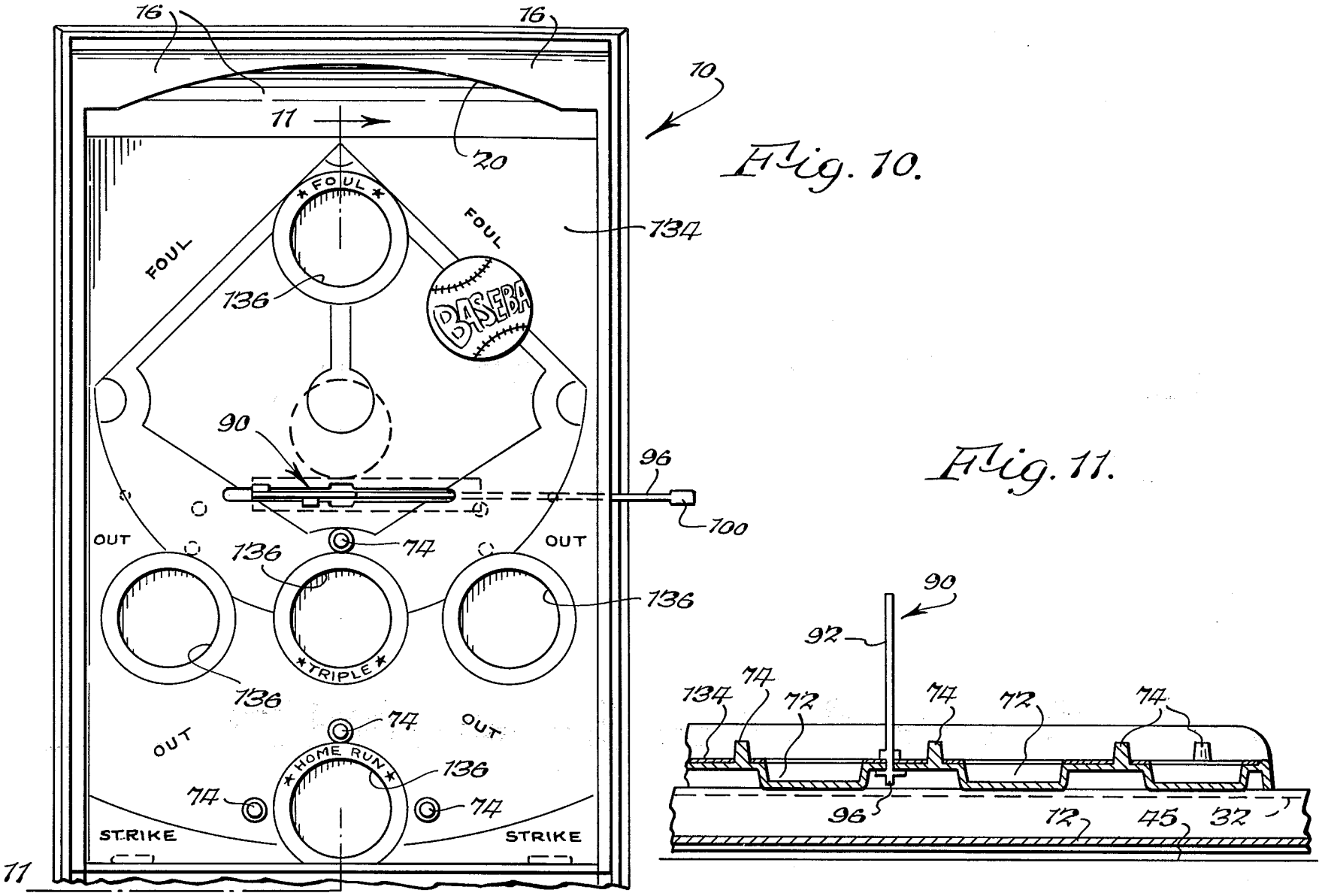
FIG. 10 is a fragmentary top plan view of the amusement game of the present invention provided with parts for simulating a baseball game.
FIG. 11 is a fragmentary sectional view taken about on line 11—11 of FIG. 10.

FIGS. 10 and 11 show the game apparatus provided with a card or plate 134 having indicia and markings for a baseball game. Card 134 is of sufficient size to cover playing surface 14, and is marked to indicate a conventional baaseball diamond with the corner corresponding to home plate being nearest to deflecting surface 16. Card 134 is provided with opening 136 in registry or alignment with certain ones of the pockets 72. In particular, the pocket nearest deflecting surface 16 is open and card 134 is marked to indicate that a player piece landing therein has the effect of a foul ball. The surface of card 134 outwardly of the baselines also is marked to indicate foul territory according to conventional baseball rules. The pocket adjacent player element 90 and on the side thereof facing deflecting surface 16 is covered by card 134 in this exemplary arrangement. The remaining pockets 72 are open, with the center pocket closest player element 90 marked to indicate a triple and the pocket at the far end of card 134 marked to indicate a home run. The projections 74 around this latter pocket or well increase the difficulty of landing a player piece therein. A player piece landing in either of the two pockets outwardly of the player element 90 or in the adjacent area incurs an out as indicated on the face of card 134.

The game of FIGS. 10 and 11 is played in a manner similar to the previously described games. One person propells or forces by hand a player piece 80, which simulates a baseball, along guide surface 12 as before, but in this instance he attempts to land the player piece in the pockets or wells designated "triple" or "home run" while avoiding the areas of card 134 and the other pockets designated foul and "out." This person uses his skill in combination with the varying shape of deflecting surface 16 and with controlled selective application of manual force to player piece 80 to cause it to land where he desires. The other person playing the game manipulates player element 90 as before to attempt to block the player piece from entering the pockets or wells marked triple and home run while allowing or guiding movement of the player piece into the out areas. After one or any predetermined number of tries or runs, the persons playing the game switch roles or positions and the score is kept in a conventional manner.

FIG. 12 shows the game apparatus provided with a card or plate 140 having indicia and markings for a football game. Card 140 is of sufficient size to cover playing surface 14, and is marked to indicate yard lines and end zones similar to a conventional football field. Card 140 is provided with openings 142 in registry or alignment with certain ones of the pockets 72. In particular, the pocket nearest deflecting surface 16 is open and marked to indicate that a player piece landing therein registers a 2 yard advance or carry of the football. The pockets 72 on the side of player element 90 all are open, with the outermost ones each marked to indicate a 5 yard advance and the center one, directly behind player element 90, marked to indicate a first down. The pocket at the far end of card 140 is marked to indicate that a player element landing therein scores a touchdown.

The game of FIG. 12 is played in a manner similar to the previously described games. One person propells or forces by hand a player piece 80, which simulates a football, along guide surface 12 as before, and in the present instance he tries to land the player piece in any of the pockets or wells, preferably the one marked "touchdown" or the one marked "first down." This person uses his skill in combination with the varying shape of deflecting surface 16 and with controlled selective application of manual force to player piece 80 to cause it to land where he desires. The other person playing the game manipulates player element 90 as before to attempt to block the player piece from entering the pockets or wells. The persons switch roles or positions according to conventional football rules and play, and the score is kept in a conventional manner.

FIGS. 13 and 14 illustrate alternative forms of deflecting surface 16 which can be included in the game apparatus of the present invention. FIG. 13 shows a game board 10' similar to board 10 having a guide surface (not shown), a deflecting surface 16' and a playing surface 14'. Deflecting surface 16' is curved with end portions of arcuate, generally semi-circular cross-section in a manner similar to deflecting surface 16' of FIGS. 1–12. However, the central portion of deflecting surface 16' shown in FIG. 13 includes an outwardly curved edge 150. As a result, the curvilinear length of the central portion of surface 16' greater than the curvilinear length of each end portion. A player piece moving along either end portion of surface 16' is given a relatively longer path or trajectory as compared to a player piece moving along the middle portion of surface 16'. Furthermore, various deflecting surfaces can be provided according to the nature of the particular game apparatus with the curvature of the edge of the deflecting surface being selected between and including the illustrative edges 20 and 150 shown herein.

FIG. 14 likewise shows a game board 10'' similar to board 10 having a guide surface (not shown), a deflecting surface 16'' and a playing surface 14''. Deflecting surface 16'' includes two outwardly curved edge portions 152 and 154 separated in a transverse direction by an inwardly curved edge portion 156. The portions 152, 154 and 156 thus define a compound curve. A player piece moving along the central portion of surface 16'' includng inwardly curved edge portion 156 is given a relatively longer path or trajectory as compared to a player piece moving along either portion of surface 16'' including the outwardly curved edge portions 152 and 154.

It is therfore apparent that the present invention accomplishes its intended objects. The provision of several indicia-bearing elements with the game apparatus, for example cards 110, 124, 134 and 140 enable different types of games to be played with a single game board or apparatus. While the game of the present invention has been illustrated for the playing of different types of athletic games, the principles of the present invention can be variously applied to other non-athletic type games. The variation in shape of deflecting surface 16 in a direction transverse to the direction of movement of a player piece along the guide surface together with the manner in which the player piece is moved by a person playing the game as well as manipulation of player element 90 by the other person playing the game make the skill of the players a factor in determining the outcome of the game. While several embodiments of the present invention have been described in detail, this is for the purpose of illustration, not limitation.

I claim:

1. An amusement game apparatus comprising:

a. means defining a playing surface;

b. a plurality of indicia-bearing elements adapted to be placed on said playing surface selectively at different times thereby defining selected playing surfaces for a corresponding plurality of different types of games;

c. a player element movably connected to said playing surface and extending from said surface and the indicia-bearing element placed thereon, said player element including means operable by a person playing the game for moving said player element along a portion of said playing surface;

d. a player piece adapted for free movement onto and along said playing surface and the indicia-bearing element thereon; and e. means for guiding and deflecting said player piece moved by a person playing the game toward and onto said playing surface and the indicia-bearing element thereon, said means for guiding and deflecting said player piece comprises a guide surface vertically spaced from said playing surface and means defining and deflecting surface positioned between said guide surface and said playing surface, and deflecting surface being shaped in a manner such that said player element moving along said guide surface and onto said deflecting surface is directed by said deflecting surface onto said playing surface, said deflecting surface being curvilinear in transverse cross section and the curvilinear arc portions thereof lying in planes substantially perpendicular to the longitudinal axis of said deflecting surface and located in the mid longitudinal axial portion of said deflecting surface being of shorter angular extent than at other portions along the longitudinal axis of said deflecting surface, whereby the movement of the player piece along said playing surface and the indicia-bearing element thereon is influenced by the movement thereof along said guiding and deflecting means and by operation of said player element, the nature of the movement of the player piece along said playing surface and indicia-bearing element affecting the outcome of the game.

2. Apparatus according to claim 1, wherein said playing surface is generally planar and wherein each of said indicia-bearing elements comprises a plate dimensioned so as to fit on said playing surface.

3. Apparatus according to claim 2, wherein said playing surface is provided with recesses therein adapted to receive the player piece and wherein each of said indicia-bearing elements is provided with openings therein for registry with certain ones of said openings depending upon the particular type of game.

4. Apparatus according to claim 2, wherein said playing surface is provided with projections extending therefrom and each of said indicia-bearing elements is provided with openings which fit over said projections, said projections serving to deflect the player piece moving along said playing surface and said indicia-bearing element.

5. Apparatus according to claim 1, wherein said guide surface meets said deflecting surface adjacent one end thereof, said playing surface is located above said guide surface and spaced from said deflecting surface when said game apparatus is in a position of use, and said deflecting surface is cylindrically curved so as to direct the player piece onto said playing surface in a generally rearward direction relative to the direction of movement of the player piece along said guide surface.

6. Apparatus according to claim 1, wherein said deflecting surface defines an edge along the direction traverse to the movement of the player piece, said edge being cut out in the midportion thereof in a manner such that a player piece moving along the central axial portion of said deflecting surface is given a relatively high trajectory and a player piece moving along either axial end portion of said deflecting surface is given a relatively low trajectory.

7. Apparatus according to claim 1, further including a player element movably connected to said playing surface and extending from said surface, said player element including means operable by a person playing the game for moving said player element along a portion of said playing surface in a direction generally transverse to the direction of movement of a player piece along said playing surface.

* * * * *

UNITED STATES PATENT AND TRADEMARK OFFICE

CERTIFICATE OF CORRECTION

PATENT NO. : 3,941,381

DATED : March 2, 1976

INVENTOR(S) : Nicholas D. Trbovich

It is certified that error appears in the above-identified patent and that said Letters Patent are hereby corrected as shown below:

Claim 1, line 23, "and" should be --a--,

Claim 1, line 25, "and" should be --said--.

Signed and Sealed this

*twenty-ninth* Day of *June 1976*

[SEAL]

*Attest:*

RUTH C. MASON
*Attesting Officer*

C. MARSHALL DANN
*Commissioner of Patents and Trademarks*